US011286639B2

(12) United States Patent
Naito

(10) Patent No.: US 11,286,639 B2
(45) **Date of Patent: *Mar. 29, 2022**

(54) WHEEL LOADER AND METHOD FOR CONTROLLING WHEEL LOADER

(71) Applicant: KOMATSU LTD., Tokyo (JP)

(72) Inventor: Toru Naito, Tokyo (JP)

(73) Assignee: KOMATSU LTD., Tokyo (JP)

( * ) Notice: Subject to any disclaimer, the term of this patent is extended or adjusted under 35 U.S.C. 154(b) by 649 days.

This patent is subject to a terminal disclaimer.

(21) Appl. No.: 16/082,006

(22) PCT Filed: Aug. 10, 2017

(86) PCT No.: PCT/JP2017/029104

§ 371 (c)(1),
(2) Date: Sep. 4, 2018

(87) PCT Pub. No.: WO2018/043091

PCT Pub. Date: Mar. 8, 2018

(65) Prior Publication Data

US 2020/0340205 A1 Oct. 29, 2020

(30) Foreign Application Priority Data

Aug. 31, 2016 (JP) ..... JP2016-169499

(51) Int. Cl.
*E02F 3/34* (2006.01)
*E02F 9/24* (2006.01)
(Continued)

(52) U.S. Cl.
CPC ..... *E02F 3/842* (2013.01); *E02F 9/262* (2013.01); *E02F 9/2083* (2013.01)

(58) Field of Classification Search
CPC ..... E02F 3/842; E02F 9/262; E02F 9/2083; E02F 3/422; E02F 3/434; E02F 9/0858;
(Continued)

(56) References Cited

U.S. PATENT DOCUMENTS 5,528,498 A 6/1996 Scholl
6,247,538 B1 6/2001 Takeda et al.
(Continued)

FOREIGN PATENT DOCUMENTS

CN 1571872 A 1/2005
CN 101246038 A 8/2008
(Continued)

*Primary Examiner* — Edwin J Toledo-Duran
(74) *Attorney, Agent, or Firm* — Faegre Drinker Biddle & Reath LLP

(57) ABSTRACT

A wheel loader includes: an operator's cab; a front wheel; a front frame configured to support front wheel such that front wheel is rotatable; a bucket; a boom having a distal end connected to bucket, and a proximal end rotatably supported by front frame; a sensor configured to measure a distance between front wheel and a loading target; and a controller configured to control an action of wheel loader. The controller causes wheel loader to perform a predetermined action for collision avoidance on condition that a distance to be measured by sensor when wheel loader travels takes a value less than or equal to a threshold value.

17 Claims, 13 Drawing Sheets

(51) Int. Cl.
*E02F 3/84* (2006.01)
*E02F 9/26* (2006.01)
*E02F 9/20* (2006.01)

(58) Field of Classification Search
CPC ..... E02F 9/24; E02F 3/34; E02F 3/431; E02F 9/2004; E02F 9/2033; E02F 9/265; B60Q 5/005; B60Q 9/008
See application file for complete search history.

(56) References Cited

U.S. PATENT DOCUMENTS

| | | | | |
|---|---|---|---|---|
| 6,470,606 | B1 | 10/2002 | Nagahiro et al. | |
| 7,603,235 | B2 | 10/2009 | Makela et al. | |
| 8,768,583 | B2 | 7/2014 | Hargrave, Jr. et al. | |
| 9,133,600 | B2 | 9/2015 | Martinsson et al. | |
| 9,206,587 | B2 | 12/2015 | Linstroth et al. | |
| 9,832,386 | B2 | 11/2017 | Hasejima et al. | |
| 10,094,093 | B2 | 10/2018 | Helepatali et al. | |
| 10,538,897 | B2 | 1/2020 | Uetake et al. | |
| 10,570,589 | B2 | 2/2020 | Eidenberger et al. | |
| 2005/0000703 | A1 | 1/2005 | Furuno et al. | |
| 2006/0097570 | A1* | 5/2006 | Doerr | B60Q 9/008 303/193 |
| 2013/0302761 | A1* | 11/2013 | Best | G09B 5/00 434/71 |
| 2014/0088824 | A1* | 3/2014 | Ishimoto | B60R 11/04 701/34.4 |
| 2016/0185346 | A1* | 6/2016 | Awamori | B60W 10/20 701/23 |
| 2016/0264133 | A1* | 9/2016 | Ohsugi | B60P 1/04 |
| 2016/0264134 | A1* | 9/2016 | Ohsugi | B60W 30/09 |
| 2017/0002541 | A1* | 1/2017 | Fletcher | E02F 9/205 |
| 2017/0002542 | A1* | 1/2017 | Fletcher | E02F 9/265 |
| 2017/0002546 | A1* | 1/2017 | Fletcher | E02F 9/261 |
| 2019/0226181 | A1 | 7/2019 | Imura et al. | |
| 2021/0122620 | A1* | 4/2021 | Schulz | B66F 9/24 |

FOREIGN PATENT DOCUMENTS

| | | | |
|---|---|---|---|
| CN | 204475392 | U | 7/2015 |
| CN | 104890661 | A | 9/2015 |
| CN | 205296249 | U | 6/2016 |
| JP | H06-193098 | A | 7/1994 |
| JP | H07-034483 | A | 2/1995 |
| JP | H10-001968 | A | 1/1998 |
| JP | H10-77659 | A | 3/1998 |
| JP | H10-88625 | A | 4/1998 |
| JP | 2003-184131 | A | 7/2003 |
| JP | 2006-195877 | A | 7/2006 |
| JP | 2007-23486 | A | 2/2007 |
| JP | 2008-133657 | A | 6/2008 |
| JP | 2008-144378 | A | 6/2008 |
| JP | 2008-303574 | A | 12/2008 |
| JP | 2010-053588 | A | 3/2010 |
| JP | 2015-214409 | A | 12/2015 |
| KR | 10-2013-0055302 | A | 5/2013 |
| KR | 10-2015-0041935 | A | 4/2015 |

* cited by examiner

WHEEL LOADER AND METHOD FOR CONTROLLING WHEEL LOADER

TECHNICAL FIELD

The present invention relates to a wheel loader and a method for controlling the wheel loader.

BACKGROUND ART

A wheel loader that is an example of self-propelled work vehicles includes a traveling apparatus that causes the vehicle to travel, and a work implement that performs various operations/services including excavation. The traveling apparatus and the work implement are each driven by driving force from an engine.

Japanese Patent Laying-Open No. 2008-303574 (PTL 1) discloses a wheel loader including a video camera or a laser distance sensor disposed on a front wheel axle case. The video camera is configured to capture an image of a road surface forward of a position of a bucket, through a clearance below the bucket. The wheel loader also includes a display apparatus configured to display an image captured by the video camera or a distance measured by the laser distance sensor on a place where an operator on an operator's seat sees the image or the distance. The operator thus monitors a status of a road surface below a work implement.

Japanese Patent Laying-Open No. 10-88625 (PTL 2) discloses an automatic excavator (e.g., a wheel loader) including a visual sensor constituted of two cameras. In the automatic excavator, the visual sensor measures a distance from the automatic excavator to a target to be excavated or a dump truck, for the sake of automatic excavation.

An operator of a wheel loader simultaneously actuates an accelerator pedal and a boom lever to load, on a bed of a dump truck, soil scooped by a bucket of a work implement. The wheel loader thus simultaneously performs fore traveling and boom-raising. Such a loading operation/service is also called "dump approach".

CITATIONS LIST

Patent Literatures

PTL 1: Japanese Patent Laying-Open No. 2008-303574
PTL 2: Japanese Patent Laying-Open No. 10-88625

SUMMARY OF INVENTION

Technical Problem

In a loading operation/service, an operator needs to operate a wheel loader so as to prevent a leading end of a front wheel from colliding with a lateral side of a dump truck and so as to prevent a work implement (particularly, a lower end of a boom) from colliding with the lateral side of the dump truck (specifically, an upper portion of a vessel). As described above, the operator needs to implement the loading operation/service while checking on the upper and lower locations at the same time.

The present disclosure has been made in view of the problem described above. The present disclosure provides a wheel loader that assists an operation by an operator in loading an excavated object such as excavated soil onto a loading target (e.g., a dump truck). The present disclosure also provides a method for controlling the wheel loader.

Solution to Problem

According to an aspect of the present disclosure, a wheel loader for loading an excavated object onto a loading target includes: an operator's cab; a front wheel; a front frame configured to support the front wheel such that the front wheel is rotatable; a bucket; a boom having a distal end connected to the bucket, and a proximal end rotatably supported by the front frame; a sensor configured to measure a distance between the front wheel and the loading target; and a controller configured to control an action of the wheel loader. The controller causes the wheel loader to perform a predetermined action for collision avoidance on condition that a distance to be measured by the sensor when the wheel loader travels takes a value less than or equal to a threshold value.

Advantageous Effects of Invention

A wheel loader according to an aspect of the present disclosure assists an operation by an operator in loading an excavated object onto a loading target.

DESCRIPTION OF EMBODIMENTS

Embodiments will be described below with reference to the drawings. It is originally planned to utilize configurations of the embodiments in appropriate combination. In addition, some of constituent elements are not employed occasionally.

A description will be given of a wheel loader with reference to the drawings. In the following description, the terms "upper", "lower", "front", "rear", "left", and "right" are defined with respect to an operator who sits in an operator's seat.

A dump truck will be described as an example of a loading target onto which an excavated object is loaded; however, the loading target is not limited thereto, but may be a non-self-propelled loading target such as a soil container.

First Embodiment

<Overall Configuration>

Figure 1:
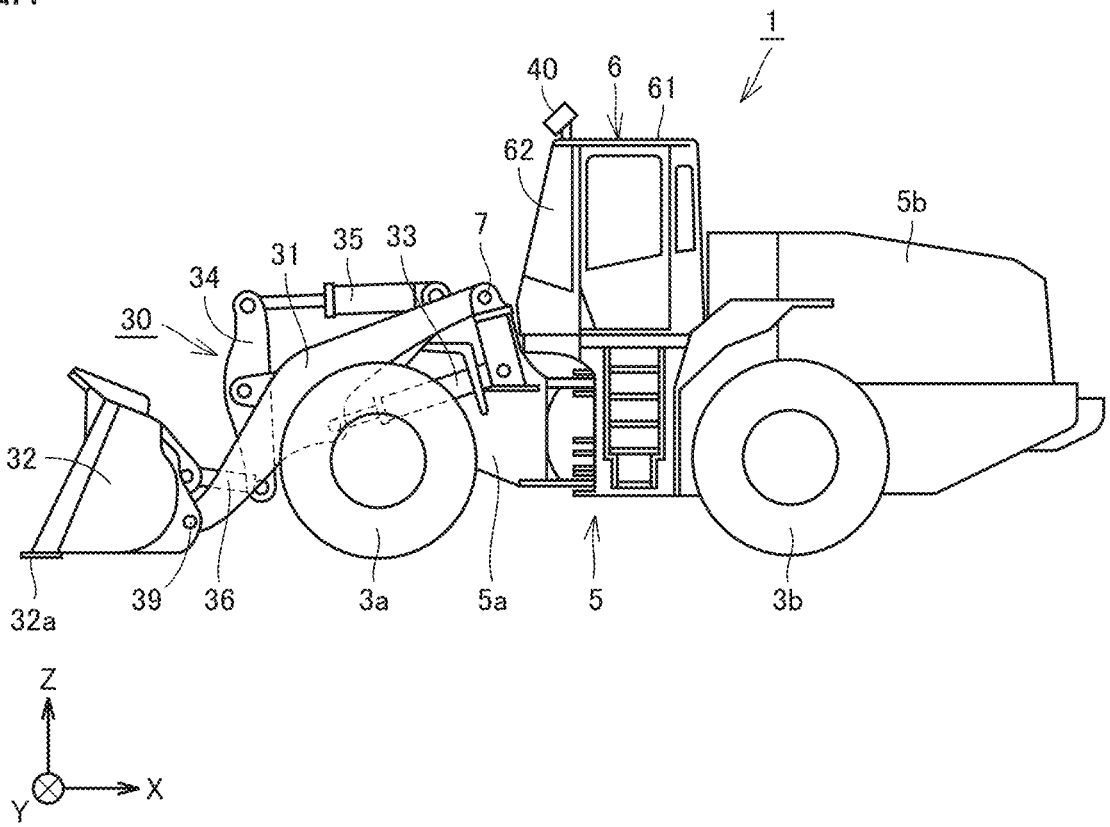
FIG. 1 is a side view of a wheel loader.
Figure 2:
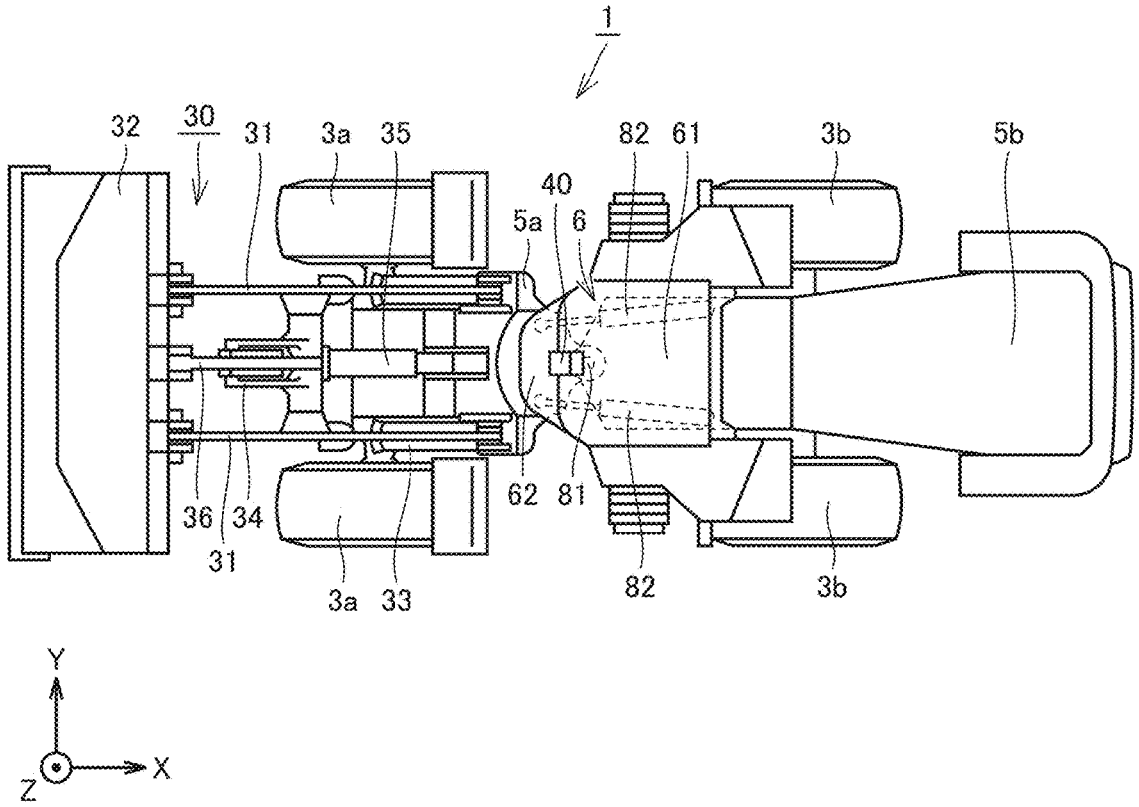
FIG. 2 is a top view of the wheel loader.

FIG. 1 is a side view of a wheel loader 1 according to a first embodiment. FIG. 2 is a top view of wheel loader 1.

As illustrated in FIGS. 1 and 2, wheel loader 1 includes a main body 5, a work implement 30, wheels 3*a* and 3*b*, and an operator's cab 6. Wheel loader 1 is self-propelled in such a manner that wheels 3*a* and 3*b* are rotated. In addition, wheel loader 1 performs desired operations/services using work implement 30.

Main body 5 includes a front frame 5*a* and a rear frame 5*b*. Front frame 5*a* and rear frame 5*b* are connected to each other by a center pin 81 so as to be swingable laterally.

Steering cylinders 82 are provided in a pair so as to extend from front frame 5*a* to rear frame 5*b*. Each steering cylinder 82 is a hydraulic cylinder to be driven by hydraulic oil from a steering pump (not illustrated). Front frame 5*a* swings relative to rear frame 5*b* by expansion and contraction of steering cylinders 82. This action changes a traveling direction of wheel loader 1.

Work implement 30 and a pair of front wheels 3*a* are mounted to front frame 5*a*. Front frame 5*a* supports front wheels 3*a* such that front wheels 3*a* are rotatable. Work implement 30 is disposed forward of main body 5. Work implement 30 is driven by hydraulic oil from a hydraulic pump 119 (see FIG. 3). Work implement 30 includes a boom 31, a pair of lift cylinders 33, a bucket 32, a bell crank 34, a tilt cylinder 35, and a tilt rod 36 connecting a distal end of bell crank 34 to bucket 32.

Boom 31 is rotatably supported by front frame 5*a*. Boom 31 has a proximal end (proximal end) mounted to front frame 5*a* by a boom pin 7 such that boom 31 is swingable. Each lift cylinder 33 has a first end mounted to front frame 5*a*. Each lift cylinder 33 has a second end mounted to boom 31. Front frame 5*a* and boom 31 are connected to each other by lift cylinders 33. Boom 31 swings upward and downward about boom pin 7 by expansion and contraction of lift cylinders 33 using the hydraulic oil from hydraulic pump 119.

FIG. 1 illustrates only one of lift cylinders 33.

Bucket 32 is rotatably supported by a leading end of boom 31. Bucket 32 is swingably directed to a distal end of boom 31 by a bucket pin 39. Tilt cylinder 35 has a first end mounted to front frame 5*a*. Tilt cylinder 35 has a second end mounted to bell crank 34. Bell crank 34 and bucket 32 are connected to each other by a link apparatus (not illustrated). Front frame 5*a* and bucket 32 are connected to each other by tilt cylinder 35, bell crank 34, and the link apparatus. Bucket 32 swings upward and downward about bucket pin 39 by expansion and contraction of tilt cylinder 35 using the hydraulic oil from hydraulic pump 119.

Operator's cab 6 and a pair of rear wheels 3*b* are mounted to rear frame 5*b*. Operator's cab 6 is mounted on main body 5. Operator's cab 6 includes, for example, a seat in which an operator sits, and devices for operations (to be described later).

Wheel loader 1 further includes a sensor 40 configured to measure a distance (hereinafter, also referred to as "distance D") between front wheels 3*a* and a dump truck as a loading target. Sensor 40 is mounted to a roof 61 of operator's cab 6. Specifically, sensor 40 is disposed on roof 61. More specifically, sensor 40 is disposed on a front end of roof 61.

As will described later, sensor 40 measures a distance between front ends of front wheels 3*a* and the dump truck. Sensor 40 senses at least an area covering the front ends of front wheels 3*a* and geographic features forward of front wheels 3*a*. Sensor 40 may be any device for measuring a distance. Examples of sensor 40 may include various devices such as an ultrasonic sensor, a laser sensor, an infrared sensor, and a camera.

Figure 3:
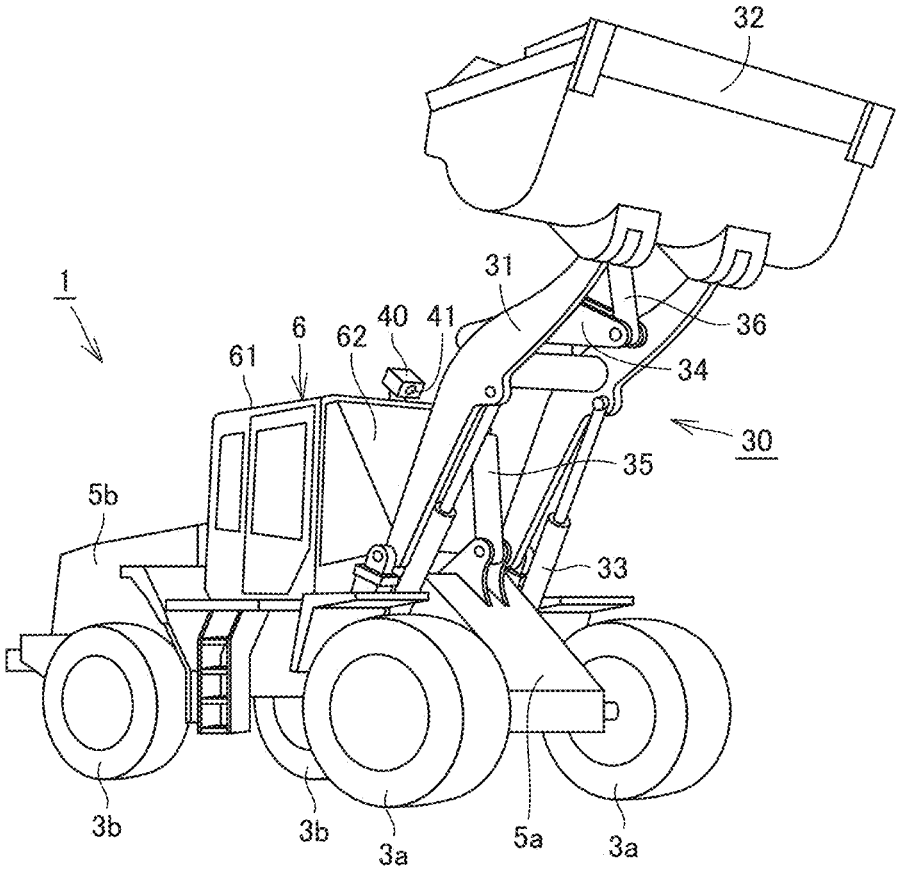
FIG. 3 is a perspective view of the wheel loader.

FIG. 3 is a perspective view of wheel loader 1. As illustrated in FIG. 3, boom 31 is raised based on an operation by the operator, so that bucket 32 is also raised. The operator decreases a tilt angle (angle θ in FIG. 12) of bucket 32 with an excavated object such as excavated soil loaded on the bucket. The excavated object is thus loaded onto the loading target such as the dump truck.

Figure 4:
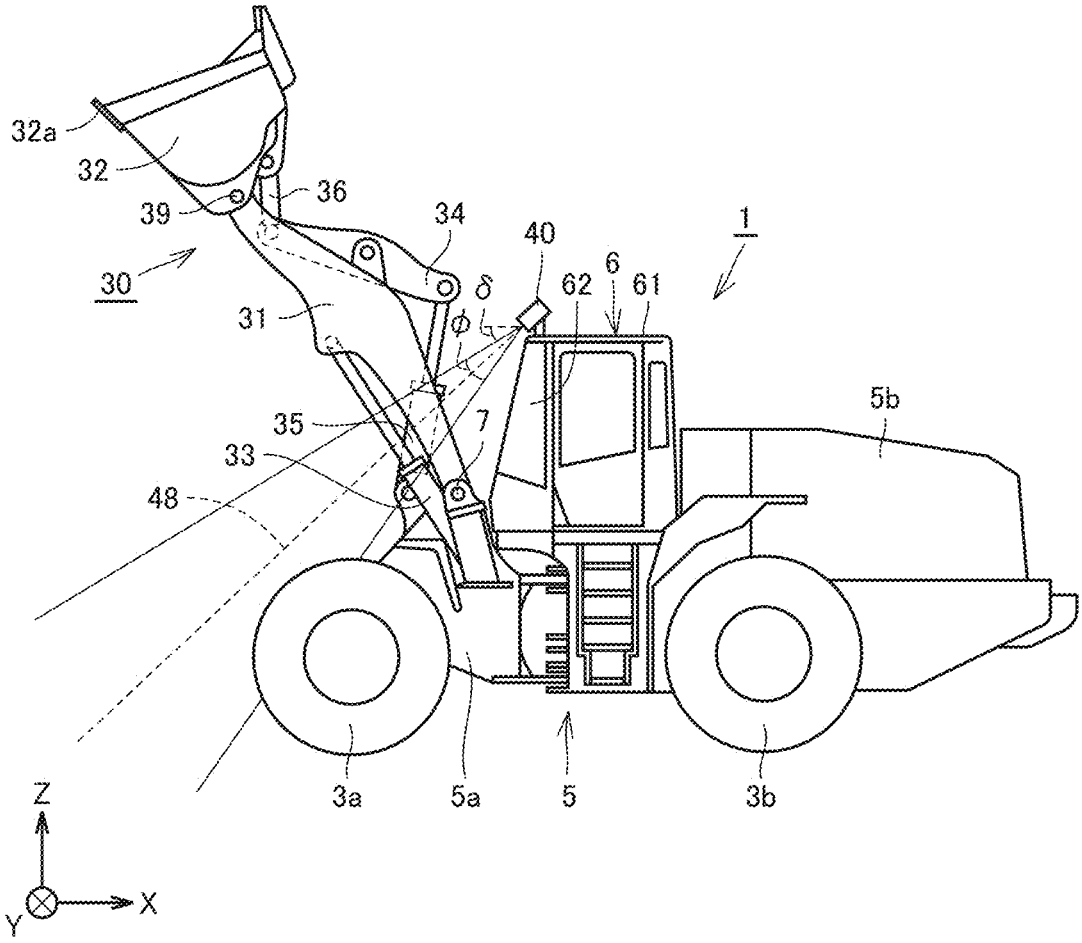
FIG. 4 schematically illustrates a sensing area of a sensor.

FIG. 4 schematically illustrates a sensing area of sensor 40. As illustrated in FIG. 4, sensor 40 is disposed such that an optical axis 48 of sensor 40 is directed downward with respect to a horizontal plane by an angle $\delta+\phi/2$. Angle δ allows sensor 40 to sense at least an area covering the front ends of front wheels 3*a* and geographic features forward of front wheels 3*a*. Angle θ represents a range capable of sensing, and corresponds to an angle of view in cases where sensor 40 is a camera.

Sensor 40 disposed as described above measures a distance between front wheels 3*a* and the dump truck as the loading target. Information acquired by sensor 40 is sent to a controller 110 (FIG. 8) of wheel loader 1 and then is subjected to data processing in controller 110 as will be described later.

In the foregoing description, sensor 40 is disposed on roof 61 so as to sense two front wheels 3*a*; however, the orientation of sensor 40 is not limited thereto. For example, sensor 40 may be disposed on roof 61 so as to sense one of two front wheels 3*a*.

Sensor 40 may be disposed on a lower side of roof 61. In this configuration, sensor 40 senses an area forward of sensor 40 through a windshield 62 of operator's cab 6.

<Dump Approach>

Figure 5:
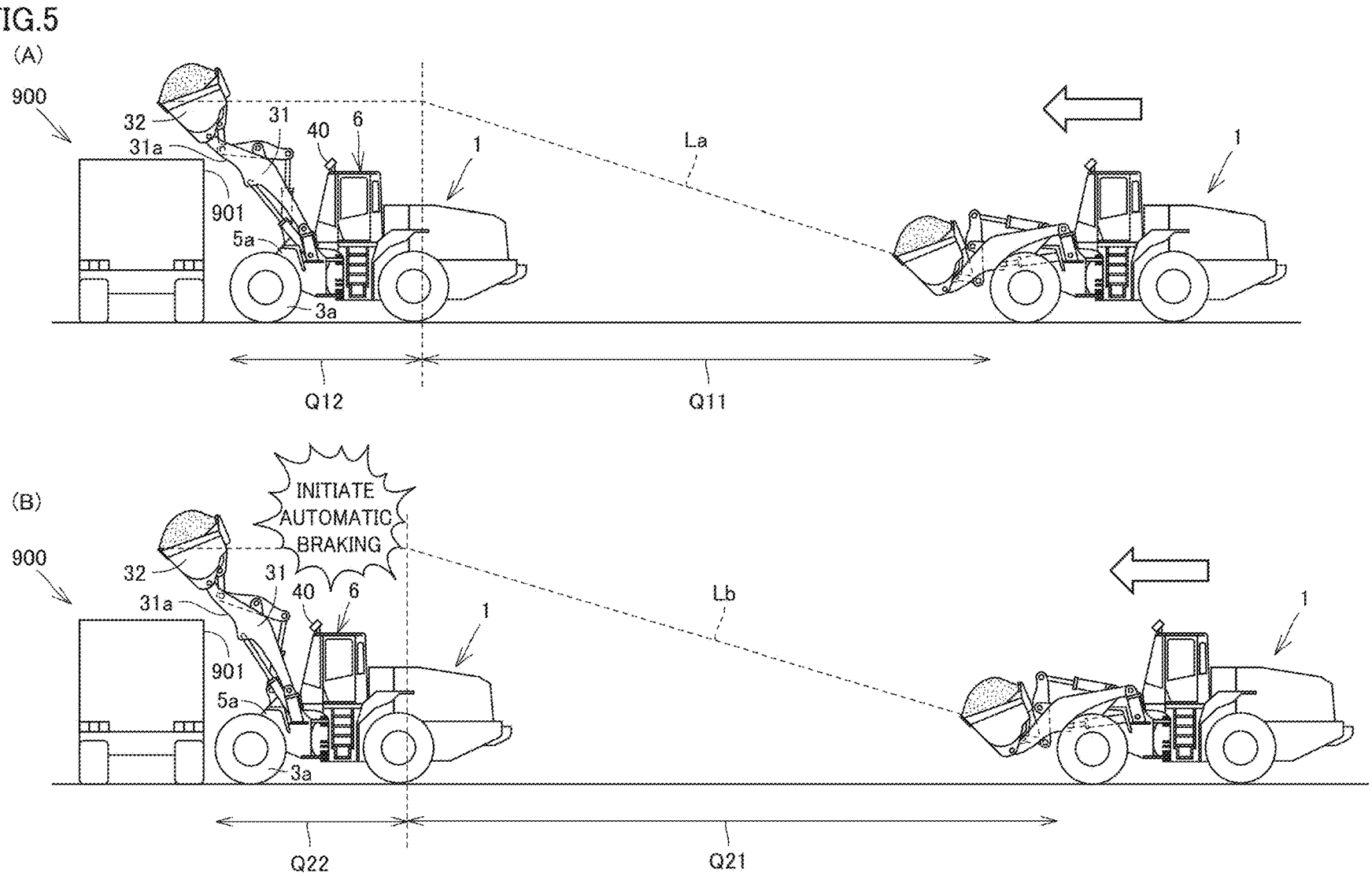
FIGS. 5(A) and 5(B) each illustrate dump approach.

FIGS. 5(A) and 5(B) each illustrate dump approach. FIG. 5(A) illustrates a typical operation by the operator in the dump approach. FIG. 5(B) illustrates a situation in which boom 31 is raised by the operator more upward than boom 31 illustrated in FIG. 5(A) is, in the dump approach.

As illustrated in FIG. 5(A), the operator initiates acceleration in a section Q11. Specifically, the operator presses an accelerator pedal (not illustrated). Also in section Q11, the operator actuates a boom control lever 122 (FIG. 6) to raise boom 31 as will be described later. In section Q11, wheel loader 1 thus travels toward dump truck 900 while performing boom-raising.

The operator initiates acceleration in section Q11 for the purpose of supplying a satisfactory amount of oil to lift cylinders 33, rather than for the purpose of causing wheel loader 1 to travel. Increasing an engine speed ensures an output of hydraulic oil from the hydraulic pump. Accordingly, the operator still presses the accelerator pedal even when he or she presses a brake pedal to decrease a vehicle speed in section Q11.

In a section Q12 subsequent to section Q11, the operator ceases the acceleration and then initiates braking. Specifically, the operator presses the brake pedal (not illustrated) instead of the accelerator pedal. The operator thus brings wheel loader 1 to a stop in front of dump truck 900. Thereafter, the operator actuates a bucket control lever 123 (FIG. 6) to load soil scooped by bucket 32 onto a bed of dump truck 900 as will be described later.

A broken line La represents a path along which bucket 32 typically moves in the series of operations.

As illustrated in FIG. 5(B), the operator initiates acceleration in a section Q21, as in a manner similar to that in section Q11. In section Q21, wheel loader 1 thus travels toward dump truck 900 while performing boom-raising, as in a manner similar to that in section Q11. In a section Q22 subsequent to section Q21, the operator ceases the acceleration and then initiates braking, as in a manner similar to that in section Q12.

A boom angle of boom 31 at a final position of section Q21 is larger than that at a final position of section Q11.

Therefore, a height of bucket 32 at the final position of section Q21 is higher than that at the final position of section Q11.

As illustrated in FIG. 5(B), if the operator raises boom 31 to a height exceeding the height illustrated in FIG. 5(A) in section Q21, the following event can occur in section Q22. In order to avoid a lower end 31*a* of boom 31 from colliding with a vessel 901 of dump truck 900, the operator causes wheel loader 1 to travel forward while seeing boom 31. As a result, the front ends of front wheels 3*a* collide with a lateral side of dump truck 900 before bucket 32 arrives at a position where the operator intends to stop wheel loader 1. According to this embodiment, the use of sensor 40 enables avoidance of this event. In FIG. 5(B), a broken line Lb represents a path of bucket 32.

Wheel loader 1 includes sensor 40 configured to measure distance D between front wheels 3*a* and dump truck 900. Controller 110 of wheel loader 1 brings wheel loader 1 to a stop on condition that distance D to be measured by sensor 40 when wheel loader 1 travels takes a value less than or equal to a threshold value.

Wheel loader 1 accordingly avoids the collision of front wheels 3*a* with dump truck 900 even when the operator neglects to confirm the position of each front wheel 3*a* because he or she pays excessive attention to the position of boom 31. Wheel loader 1 therefore assists the operation by the operator in the dump approach.

<Functional Configuration>

Figure 6:
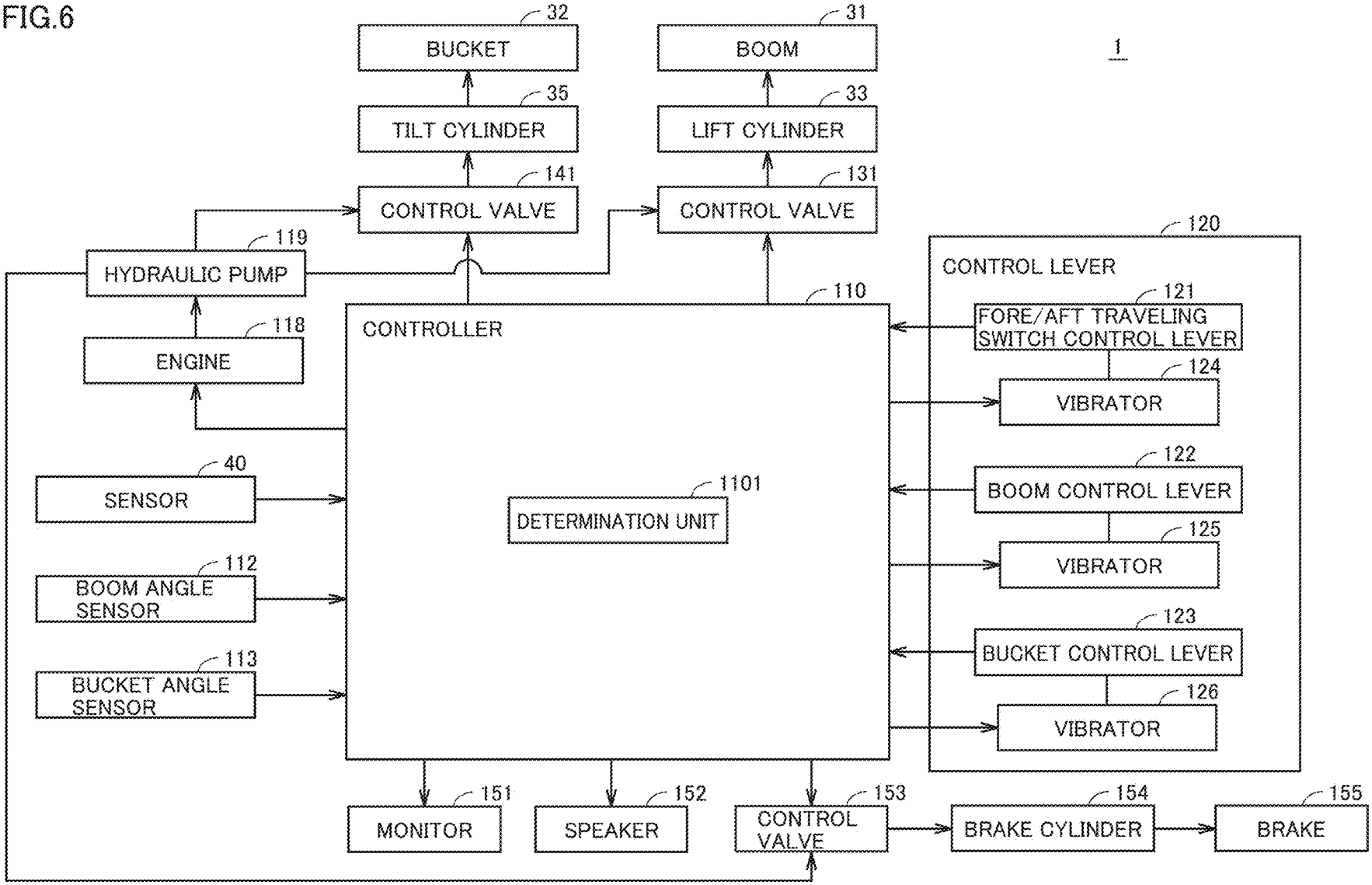
FIG. 6 is a block diagram of a system configuration of the wheel loader.

FIG. 6 is a block diagram of a system configuration of wheel loader 1. As illustrated in FIG. 6, wheel loader 1 includes boom 31, bucket 32, lift cylinders 33, tilt cylinder 35, sensor 40, controller 110, a boom angle sensor 112, a bucket angle sensor 113, an engine 118, hydraulic pump 119, a control lever 120, control valves 131, 141, and 153, a monitor 151, a speaker 152, a brake cylinder 154, and a brake 155.

Control lever 120 includes a fore/aft traveling switch control lever 121, boom control lever 122, bucket control lever 123, and vibrators 124, 125, and 126. Controller 110 includes a determination unit 1101.

Controller 110 controls the overall actions of wheel loader 1. Controller 110 controls, for example, a rotation speed of engine 118, based on the actuation of the accelerator pedal (not illustrated). In addition, the controller receives a signal based on the actuation of control lever 120 by the operator, and then causes wheel loader 1 to perform an action in accordance with the actuation.

Hydraulic pump 119 is driven by an output from engine 118. Hydraulic pump 119 supplies the hydraulic oil to lift cylinders 33 via control valve 131 such that boom 31 is driven. Boom 31 is raised or lowered by actuation of boom control lever 122 in operator's cab 6. Hydraulic pump 119 also supplies the hydraulic oil to tilt cylinder 35 via control valve 141 such that bucket 32 is driven. Bucket 32 is acted by actuation of bucket control lever 123 in operator's cab 6.

Controller 110 sends, to control valve 153, a command signal based on actuation of the brake pedal (not illustrated). Control valve 153 allows hydraulic pump 119 to supply, to brake cylinder 154, hydraulic oil based on the command signal. Brake 155 thus receives force according to the actuation of the brake pedal.

Controller 110 successively receives results of sensing from sensor 40. In the dump approach, determination unit 1101 of controller 110 determines whether distance D to be measured by sensor 40 takes a value less than or equal to threshold value Th. When determination unit 1101 determines that the value of distance D is less than or equal to threshold value Th, controller 110 brings wheel loader 1 to a stop.

Controller 110 receives a signal according to a boom angle from boom angle sensor 112. Controller 110 also receives a signal according to a tilt angle from bucket angle sensor 113. A description will be given of how to utilize signals (results of sensing) output from boom angle sensor 112 and bucket angle sensor 113, later.

Controller 110 causes monitor 151 to display various images. Controller 110 causes speaker 152 to output a predetermined sound. A description will be given of how to utilize monitor 151 and speaker 152, later.

Vibrator 124 is configured to vibrate fore/aft traveling switch control lever 121. Vibrator 125 is configured to vibrate boom control lever 122. Vibrator 126 is configured to vibrate bucket control lever 123. A description will be given of how to utilize vibrators 124 to 126, later.

<Control Structure>

Figure 7:
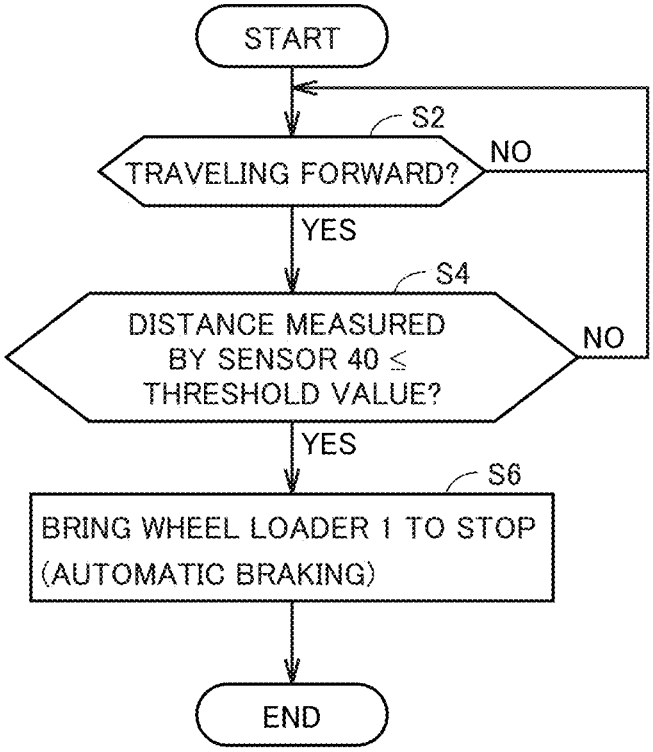
FIG. 7 is a flowchart of a processing flow in the wheel loader.

FIG. 7 is a flowchart of a processing flow in wheel loader 1. As illustrated in FIG. 7, in step S2, controller 110 determines whether wheel loader 1 is traveling forward. When controller 110 determines that wheel loader 1 is traveling forward (YES in step S2), then, in step S4, controller 110 determines whether distance D measured by sensor 40 takes a valueless than or equal to threshold value Th. When controller 110 determines that wheel loader 1 is not traveling forward (NO in step S2), the processing goes back to step S2.

When controller 110 determines that the value of distance D is less than or equal to threshold value Th (YES in step S4), then, in step S6, controller 110 brings wheel loader 1 to a stop. Typically, controller 110 initiates braking even when the operator does not press the braking pedal. When controller 110 determines that the value of distance D is larger than threshold value Th (NO in step S4), the processing goes back to step S2.

As described above, controller 110 brings wheel loader 1 to a stop on condition that distance D takes a value less than or equal to threshold value Th. Wheel loader 1 may be configured to allow the operator to forcibly cease the control by controller 110. Examples of such an operation by the operator may include an operation to press down a predetermined button (not illustrated), an operation to actuate boom control lever 122 to lower boom 31, and an operation to shift fore/aft traveling switch control lever 121 from a fore traveling position to an aft traveling position. In wheel loader 1, the operator performs the operation to shift fore/aft traveling switch control lever 121 from the fore traveling position to the aft traveling position even when wheel loader 1 is traveling forward (i.e., is not stopping).

<Advantages>

(1) As described above, sensor 40 is disposed at a predetermined position on roof 61 of operator's cab 6. Controller 110 causes wheel loader 1 to perform the predetermined action for collision avoidance, that is, causes wheel loader 1 to come to a stop on condition that distance D to be measured by sensor 40 when wheel loader 1 travels takes a value less than or equal to threshold value Th.

With this configuration, wheel loader 1 comes to a stop before collision of front wheels 3*a* with dump truck 900 in the dump approach. Wheel loader 1 therefore avoids the collision of front wheels 3*a* with dump truck 900 even when the operator neglects to confirm the position of each front wheel 3*a*. Wheel loader 1 thus assists the operation by the operator in the dump approach.

(2) Specifically, the predetermined position corresponds to the front end of roof 61. With this configuration, a position where sensor 40 is disposed is set to be lower in height than a position where sensor 40 is to be disposed on a rear end of roof 61.

Second Embodiment

A description will be given of a wheel loader according to a second embodiment with reference to the drawings. It should be noted that a description will be given of different configurations of the wheel loader according to the second embodiment from those of wheel loader 1 according to the first embodiment; therefore, no description will be given of similar configurations of the wheel loader according to the second embodiment to those of wheel loader 1 according to the first embodiment.

Figure 8:
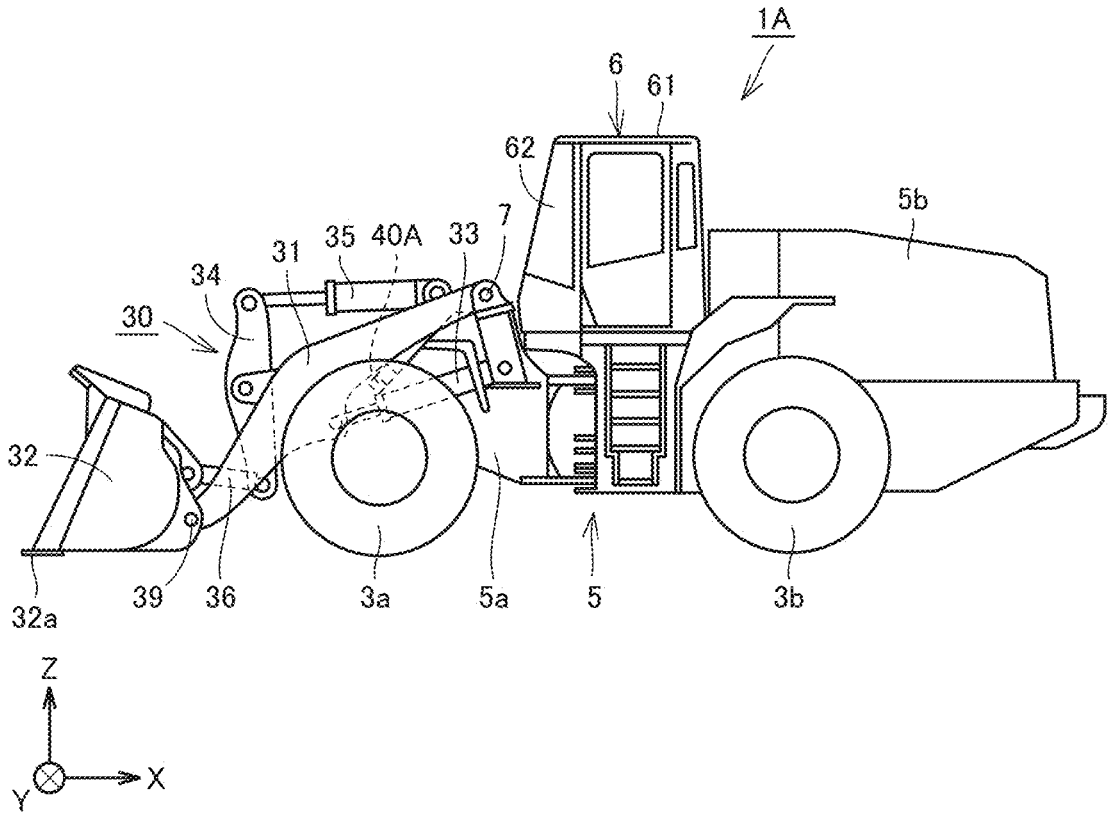
FIG. 8 is a side view of a wheel loader.
Figure 9:
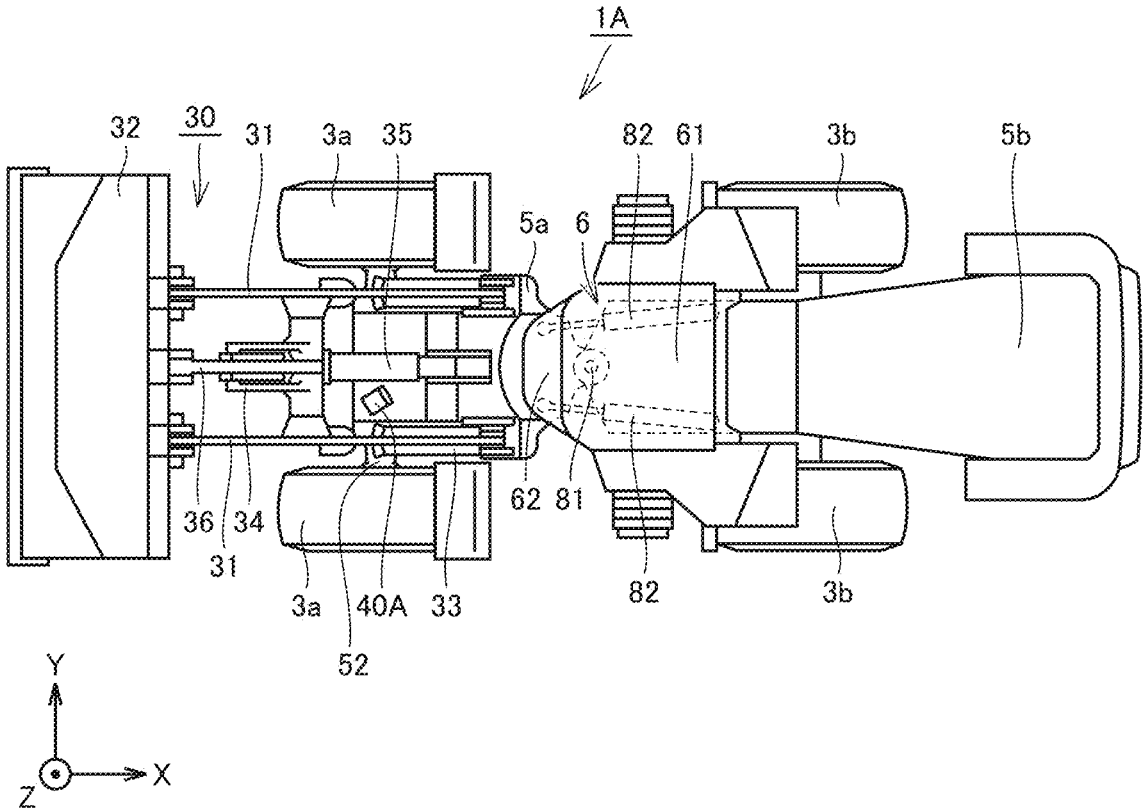
FIG. 9 is a top view of the wheel loader.
Figure 10:
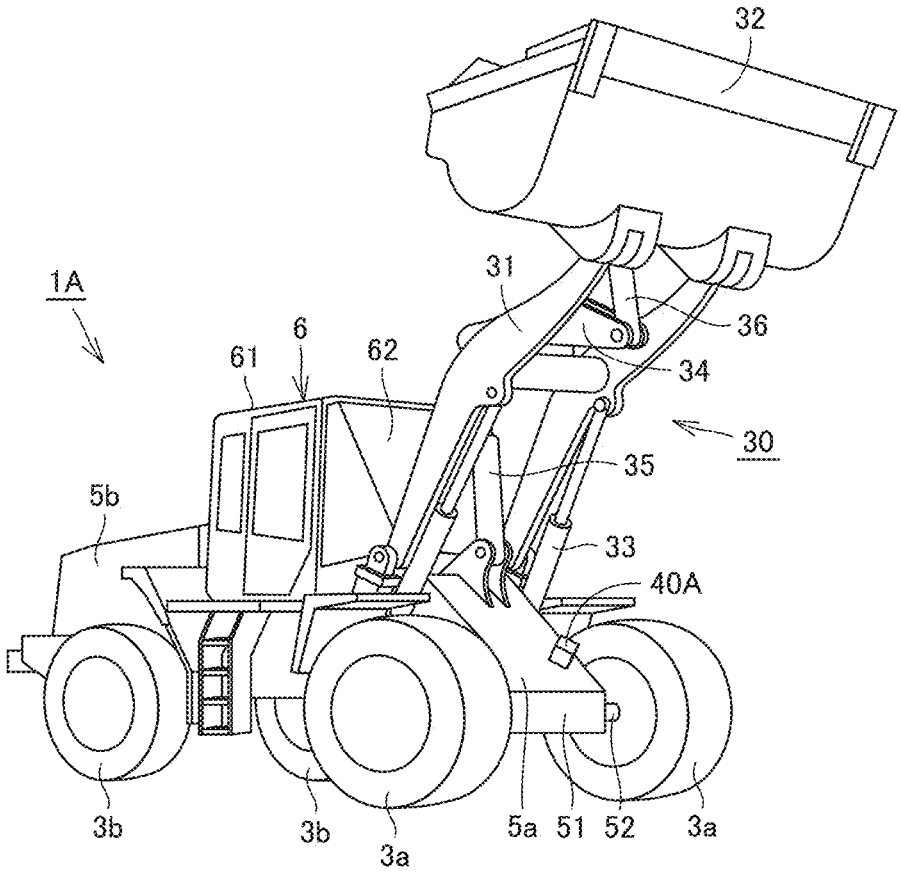
FIG. 10 is a perspective view of the wheel loader.

FIG. 8 is a side view of wheel loader 1A according to the second embodiment. FIG. 9 is a top view of wheel loader 1A. FIG. 10 is a perspective view of wheel loader 1A.

As illustrated in FIGS. 8, 9, and 10, wheel loader 1A has a hardware configuration similar to the hardware configuration of wheel loader 1A, except for a sensor 40A provided instead of sensor 40.

Sensor 40A is disposed on an upper face of a front frame 5*a*. Sensor 40A is disposed at a predetermined position that is closer to a front end 51 (see FIG. 10) of front frame 5*a* than to a position where a boom 31 is supported. Specifically, sensor 40A is disposed closer to the front end of front frame 5*a* than to a boom pin 7. Typically, sensor 40A is disposed above axles 52 of front wheels 3*a*.

Sensor 40A is disposed between left boom 31 and a tilt cylinder 35, as seen in top view in a Y direction illustrated in FIG. 9. Sensor 40A is disposed such that an optical axis is directed toward a left front side of wheel loader 1A, as seen in top view of FIG. 9.

Sensor 40A measures a distance D between left front wheel 3*a* and dump truck 900 in dump approach, as in a manner similar to that by sensor 40. Sensor 40A may be any device for measuring distance D. Examples of sensor 40A may include various devices such as an ultrasonic sensor, a laser sensor, an infrared sensor, and a camera.

Sensor 40A may be disposed between right boom 31 and tilt cylinder 35, as seen in top view in the Y direction illustrated in FIG. 9. Alternatively, sensor 40A may be disposed beneath tilt cylinder 35 as seen in top view of FIG. 9. Sensor 40A is not necessarily configured to measure distance D between left front wheel 3*a* and dump truck 900. Sensor 40 may be disposed to measure a distance between at least one of right front wheel 3*a* and left front wheel 3*a* and dump truck 900.

Figure 11:
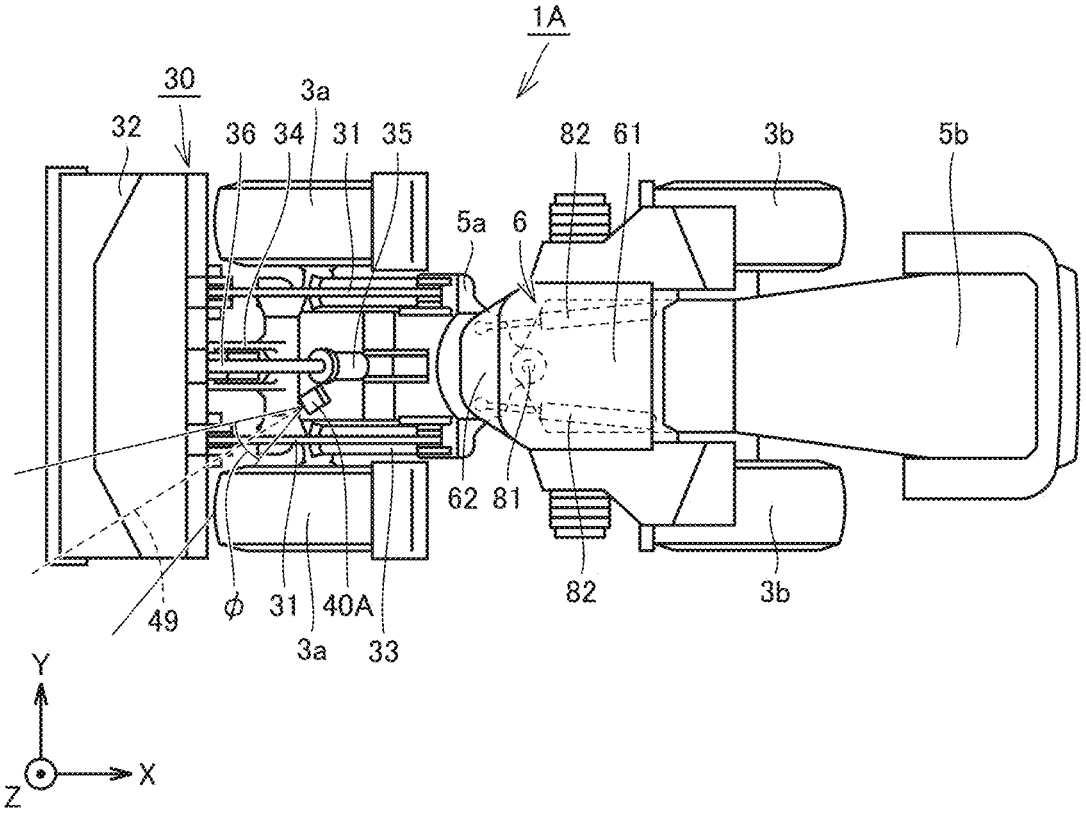
FIG. 11 schematically illustrates a sensing area of a sensor.

FIG. 11 schematically illustrates a sensing area of sensor 40A. As illustrated in FIG. 11, sensor 40A is disposed such that optical axis 49 of sensor 40A is directed to a position forward of left front wheel 3*a*. Sensor 40A may be disposed such that optical axis 49 and left front wheel 3*a* cross each other so as to sense a predetermined region forward of left front wheel 3*a*.

Sensor 40A disposed as described above measures distance D between front wheels 3*a* and the dump truck as the loading target. Information acquired by sensor 40A is sent to a controller 110 of wheel loader 1A and then is subjected to data processing in controller 110.

Controller 110 of wheel loader 1A operates like controller 110 of wheel loader 1. Specifically, controller 110 causes wheel loader 1A to perform a predetermined action for collision avoidance, that is, causes wheel loader 1A to come to a stop on condition that distance D to be measured by sensor 40A when wheel loader 1A travels takes a value less than or equal to a threshold value Th.

With this configuration, wheel loader 1A comes to a stop before collision of front wheels 3*a* with dump truck 900 in the dump approach. Wheel loader 1A therefore avoids the collision of front wheels 3*a* with dump truck 900 even when the operator neglects to confirm the position of each front wheel 3*a*. Wheel loader 1A thus assists the operation by the operator in the dump approach.

<<Modifications>>

A description will be given of a modification of wheel loader 1 according to the first embodiment and a modification of wheel loader 1A according to the second embodiment with reference to the drawings.

(1) Predetermined Action for Collision Avoidance

In the first and second embodiments, controller 110 causes wheel loader 1 to perform the predetermined action, that is, causes wheel loader 1 to come to a stop on condition that distance D to be measured by sensor 40, 40A when wheel loader 1A travels takes a value less than or equal to threshold value Th. However, the predetermined action is not limited to the action to cause wheel loader 1 to come to a stop.

Controller 110 may cause speaker 152 to output a predetermined audible notification (audible alarm), in place of the control for bringing wheel loader 1 to a stop. Alternatively, controller 110 may cause monitor 151 to display a predetermined warning. These configurations each make the operator aware of an abnormal state. Specifically, the operator is able to recognize that wheel loader 1, 1A almost collides with the dump truck.

From the viewpoint of attracting attention to the operator, preferably, speaker 152 outputs the predetermined audible notification (audible alarm) so as to increase a volume of the audible notification or outputs the audible notification at shorter time intervals, as distance D measured by sensor 40, 40A becomes shorter.

Controller 110 may send a command to each of vibrators 124 to 126 such that vibrators 124 to 126 start to vibrate. The vibrations of vibrators 124, 125, and 126 vibrate corresponding control levers 121, 122, and 123. This configuration also makes the operator aware of an abnormal state.

Wheel loader 1, 1A may be configured to perform the action to raise boom 31, the output of the predetermined audible alarm from speaker 152, the display of the predetermined warning on monitor 151, and the vibrations of vibrators 124 to 126 in appropriate combination.

(2) Control with Boom Angle Taken into Consideration

A distance between front wheels 3*a* and boom 31 of which the angle takes a value less than a predetermined value is shorter than a distance between front wheels 3*a* and boom 31 of which the angle takes a value greater than or equal to the predetermined value. In addition, the operator pays attention to the positions of boom 31 and bucket 32 rather than the positions of front wheels 3*a* as boom 31 is raised. Therefore, controller 110 may be configured to cause wheel loader 1, 1A to perform the predetermined action on condition that the angle of boom 31 takes a value greater than or equal to the predetermined value.

For example, controller 10 causes wheel loader 1, 1A to perform the predetermined action on condition that the distal end of boom 31 is higher in position than the proximal end of boom 31. With this configuration, controller 110 causes wheel loader 1, 1A to perform the predetermined action on condition that distance D measured by sensor 40, 40A takes a value less than or equal to threshold value Th and boom 31 is in a substantially horizontal posture.

(3) Control with Tilt Angle Taken into Consideration

Figure 12:
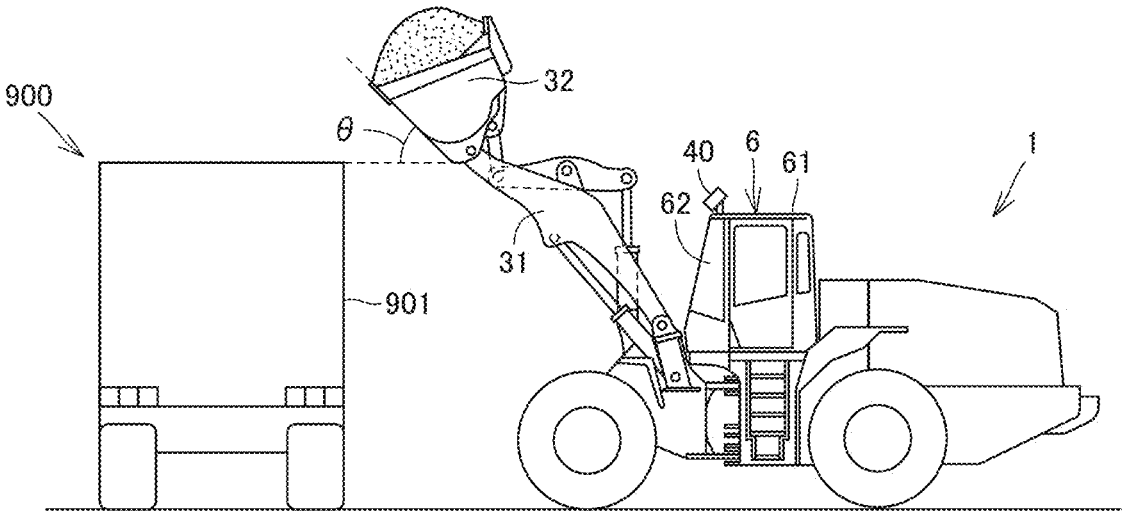
FIG. 12 illustrates a tilt angle θ of a bucket.

FIG. 12 illustrates a tilt angle θ of bucket 32. It should be noted that FIG. 12 illustrates wheel loader 1. As illustrated in FIG. 12, since an excavated object such as soil is loaded on bucket 32 in the dump approach, the operator needs to set tilt angle θ to be larger than a predetermined angle (hereinafter, also referred to as "angle θ1").

Therefore, wheel loader 1, 1A is not configured to always perform the predetermined action on condition that distance D takes a value less than or equal to threshold value Th, but may be configured to perform the predetermined action on condition that the tilt angle of bucket 32 is greater than or equal to predetermined angle θ1.

With this configuration, in a situation in which wheel loader 1, 1A approaches dump truck 900 with an excavated object loaded on bucket 32, wheel loader 1, 1A performs the predetermined action on condition that distance D takes a value less than or equal to threshold value Th. On the other hand, in a situation in which wheel loader 1, 1A approaches dump truck 900 with no excavated object loaded on bucket 32, wheel loader 1, 1A does not perform the predetermined action on condition that the value of distance D is less than or equal to threshold value Th.

As described above, wheel loader 1, 1A approaching dump truck 900 does not perform the predetermined action on condition that no excavated object is loaded on bucket 32.

Figure 13:
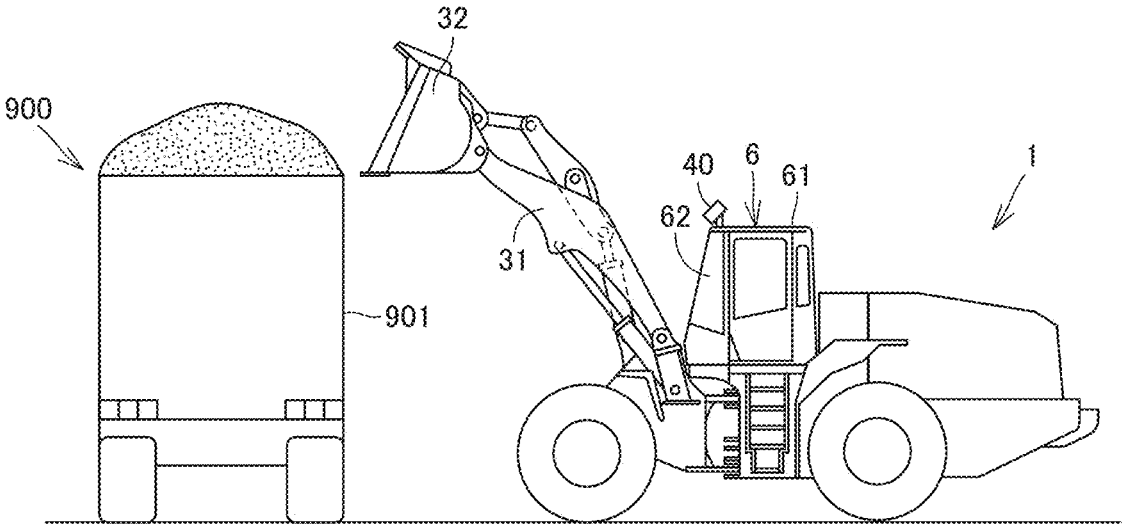
FIG. 13 illustrates how to level off an excavated object.

FIG. 13 illustrates how to level off an excavated object. It should be noted that FIG. 13 illustrates wheel loader 1. As illustrated in FIG. 13, when the operator operates wheel loader 1 to load an excavated object onto vessel 901 of dump truck 900, the excavated object can be heaped on vessel 901 beyond the height of vessel 901. In such a case, the operator sets the tilt angle of bucket 32 to be less than or equal to a predetermined angle (hereinafter, referred to as "angle θ2") that is smaller than angle θ1. The operator then operates bucket 32 to drop the excavated object heaped beyond the upper side of vessel 901. Typically, tilt angle θ of bucket 32 is set at zero (i.e., a state in which a cutting edge 32*a* is horizontal to main body 5), and then the soil heaped beyond the upper side of vessel 901 is dropped onto the ground opposite from wheel loader 1, 1A across dump truck 900.

The operator fails to level off the excavated object if wheel loader 1 comes to a stop since the value of distance D is less than or equal to threshold value Th. Hence, controller 110 does not bring wheel loader 1 to a stop on condition that tilt angle θ is less than or equal to angle θ2 that is smaller than angle θ1. This configuration allows the operator to level off the excavated object.

(4) Stop of Control in Aft Traveling

In aft traveling of wheel loader 1, 1A, front wheels 3*a* never collide with dump truck 900 even when the value of distance D is less than or equal to threshold value Th. Wheel loader 1, 1A therefore has no necessity to perform the predetermined action. Hence, controller 110 may be configured to cause wheel loader 1, 1A to stop the predetermined action after a transition of wheel loader 1, 1A from a fore traveling state to an aft traveling state. This configuration avoids execution of unnecessary control.

<<Additional Remarks>>

A wheel loader for loading an excavated object onto a loading target includes: an operator's cab; a front wheel; a front frame configured to support the front wheel such that the front wheel is rotatable; a bucket; a boom having a distal end connected to the bucket, and a proximal end rotatably supported by the front frame; a sensor configured to measure a distance between the front wheel and the loading target; and a controller configured to control an action of the wheel loader. The controller causes the wheel loader to perform a predetermined action for collision avoidance on condition that a distance to be measured by the sensor when the wheel loader travels takes a value less than or equal to a threshold value.

The wheel loader accordingly avoids collision of the front wheel with the loading target even when an operator neglects to confirm a position of the front wheel because he or she pays excessive attention to a position of the boom. The wheel loader thus assists an operation by the operator in loading the excavated object, such as excavated soil, onto the loading target.

Preferably, the sensor is disposed at a first position on a roof of the operator's cab. Also preferably, the first position corresponds to a front end of the roof.

With this configuration, a position where the sensor is disposed is set to be lower in height than a position where the sensor is to be disposed on a rear end of the roof.

Preferably, the sensor is disposed at a second position in the front frame, the second position being closer to a front end of the front frame than to a position where the boom is supported. Also preferably, the second position is above an axle of the front wheel.

With this configuration, the front wheel is located forward of the sensor. The sensor thus measures a distance between the front wheel and the dump truck.

Preferably, the predetermined action corresponds to an action to cause the wheel loader to come to a stop.

This configuration enables avoidance of collision of the front wheel with the loading target since the wheel loader comes to a stop on condition that the distance measured takes a value less than or equal to the threshold value.

Preferably, the predetermined action corresponds to an action to output a predetermined audible notification.

This configuration allows the operator to perform an operation to avoid collision of the boom with the loading target in such a manner that the operator listens to the audible notification before the collision of the boom with the loading target.

Preferably, the controller increases a volume of the audible notification or shortens a time interval of the output of the audible notification, as the distance measured by the sensor becomes shorter.

This configuration strongly attracts attention to the operator as compared with a configuration in which a certain volume of audible notification is output continuously or at regular time intervals irrespective of a distance.

Preferably, the wheel loader further includes a control lever configured to operate the wheel loader. The predetermined action corresponds to an action to vibrate the control lever.

This configuration allows the operator to perform the operation to avoid collision of the boom with the loading target in such a manner that the operator feels the vibration of the control lever before the collision of the boom with the loading target.

Preferably, the controller causes the wheel loader to perform the predetermined action on condition that an angle of the boom takes a value greater than or equal to a predetermined value.

With this configuration, the controller causes the wheel loader to perform the predetermined action on condition that the wheel loader is in such a state in which the operator pays attention to the position of the boom rather than the position of the front wheel.

Preferably, the controller causes the wheel loader to perform the predetermined action on condition that the distal end of the boom is higher in position than the proximal end of the boom.

With this configuration, the controller causes the wheel loader to perform the predetermined action on condition that the distance measured by the sensor takes a value less than or equal to the threshold value and the boom is in a substantially horizontal posture.

Preferably, the controller causes the wheel loader to perform the predetermined action on condition that a tilt angle of the bucket takes a value greater than or equal to a first value.

This configuration prevents the wheel loader approaching the loading target from performing the predetermined action for collision avoidance on condition that no excavated object is loaded on the bucket.

Preferably, the controller causes the wheel loader not to perform the predetermined action on condition that the tilt angle takes a value less than or equal to a second value that is smaller than the first value.

With this configuration, the operator levels off the excavated object since the wheel loader stops automatic control for boom-raising.

Preferably, the controller causes the wheel loader to stop the predetermined action on condition that the controller receives a predetermined input based on an operation by the operator.

With this configuration, the operator forcibly stops the control for performing the predetermined action on condition that the distance between the front wheel and the loading target takes a value less than or equal to the threshold value.

Preferably, the wheel loader further includes a fore/aft traveling switch lever configured to switch between fore traveling of the wheel loader and aft traveling of the wheel loader. The operation by the operator corresponds to an operation to shift the fore/aft traveling switch lever from a fore traveling position to an aft traveling position.

With this configuration, the fore/aft traveling switch lever switching operation allows a forcible stop of the control for performing the predetermined action on condition that the distance between the front wheel and the loading target takes a value less than or equal to the threshold value.

Preferably, the controller causes the wheel loader to stop the predetermined action after a transition of the wheel loader from a fore traveling state to an aft traveling state.

With this configuration, in the aft traveling state, the controller stops the control for causing the wheel loader to perform the predetermined action on condition that the distance between the front wheel and the loading target takes a value less than or equal to the threshold value.

A method for controlling a wheel loader configured to load an excavated object onto a loading target includes the steps of: measuring a distance between a wheel of the wheel loader and the loading target; determining that the distance measured takes a value less than or equal to a threshold value when the wheel loader travels; and causing the wheel loader to perform a predetermined action for collision avoidance on condition that the value of the distance measured is less than or equal to the threshold value.

The wheel loader accordingly avoids collision of the front wheel with the loading target even when the operator neglects to confirm the position of the front wheel because he or she pays excessive attention to the position of the boom. The wheel loader thus assists an operation by the operator in loading the excavated object, such as excavated soil, onto the loading target.

It should be understood that the embodiments disclosed herein are in all aspects illustrative and not restrictive. The scope of the present invention is defined by the appended claims rather than the foregoing description, and all changes that fall within metes and bounds of the claims, or equivalence such metes and bounds thereof are therefore intended to be embraced by the claims.

REFERENCE SIGNS LIST

1, 1A: wheel loader, 3*a*: front wheel, 3*b*: rear wheel, 5: main body, 5*a*: front frame, 5*b*: rear frame, 6: operator's cab, 7: boom pin, 30: work implement, 31: boom, 31*a*: lower end, 32: bucket, 32*a*: cutting edge, 33: lift cylinder, 34: bell crank, 35: tilt cylinder, 36: tilt rod, 39: bucket pin, 40, 40A: sensor, 48, 49: optical axis, 51: front end, 52: axle, 61: roof, 62: windshield, 81: center pin, 82: steering cylinder, 900: dump truck, 901: vessel, Q11, Q12, Q21, Q22: section.

The invention claimed is:

1. A wheel loader comprising:

a front wheel;

a front frame configured to support the front wheel such that the front wheel is rotatable;

a bucket;

a boom having a distal end connected to the bucket, and a proximal end rotatably supported by the front frame;

a sensor that measures a distance from the front wheel to a loading target onto which an excavated object is to be loaded by the wheel loader; and a controller configured to control an action of the wheel loader, wherein the controller causes the wheel loader, when the wheel loader travels, to perform a predetermined action for collision avoidance on condition that the distance measured by the sensor is a value less than or equal to a threshold value.

2. The wheel loader according to claim 1, wherein the sensor is disposed at a first position on a roof of an operator's cab.

3. The wheel loader according to claim 2, wherein the first position corresponds to a front end of the roof.

4. The wheel loader according to claim 1, wherein the sensor is disposed at a second position in the front frame, the second position being closer to a front end of the front frame than to a position where the boom is supported.

5. The wheel loader according to claim 4, wherein the second position is above an axle of the front wheel.

6. The wheel loader according to claim 1, wherein the predetermined action corresponds to an action to cause the wheel loader to come to a stop.

7. The wheel loader according to claim 1, wherein the predetermined action corresponds to an action to output a predetermined audible notification.

8. The wheel loader according to claim 7, wherein the controller increases a volume of the audible notification or shortens a time interval of the output of the audible notification, as the distance measured by the sensor becomes shorter.

9. The wheel loader according to claim 1, further comprising:

a control lever configured to operate the wheel loader, wherein the predetermined action corresponds to an action to vibrate the control lever.

10. The wheel loader according to claim 1, wherein the controller causes the wheel loader to perform the predetermined action on condition that an angle of the boom takes a value greater than or equal to a predetermined value.

11. The wheel loader according to claim 10, wherein the controller causes the wheel loader to perform the predetermined action on condition that the distal end of the boom is higher in position than the proximal end of the boom.

12. The wheel loader according to claim 1, wherein the controller causes the wheel loader to perform the predetermined action on condition that a tilt angle of the bucket takes a value greater than or equal to a first value.

13. The wheel loader according to claim 12, wherein the controller causes the wheel loader not to perform the predetermined action on condition that the tilt angle takes a value less than or equal to a second value that is smaller than the first value.

14. The wheel loader according to claim 1, wherein the controller causes the wheel loader to stop the predetermined action on condition that the controller receives a predetermined input based on an operation by the operator.

15. The wheel loader according to claim 14, further comprising:

a fore/aft traveling switch lever configured to switch between fore traveling of the wheel loader and aft traveling of the wheel loader, wherein the operation by the operator corresponds to an operation to shift the fore/aft traveling switch lever from a fore traveling position to an aft traveling position.

16. The wheel loader according to claim 1, wherein the controller causes the wheel loader to stop the predetermined action after a transition of the wheel loader from a fore traveling state to an aft traveling state.

17. A method for controlling a wheel loader, comprising the step of:

measuring a distance from a wheel of the wheel loader to a loading target onto which an excavated object is to be loaded by the wheel loader;

determining that the distance measured is a value less than or equal to a threshold value; and causing the wheel loader, when the wheel loader travels, to perform a predetermined action for collision avoidance on condition that the value of the distance measured is less than or equal to the threshold value.

* * * * *